US005151006A

United States Patent [19]

Marttila et al.

[11] Patent Number: 5,151,006

[45] Date of Patent: Sep. 29, 1992

[54] AUTOMATIC CHARGING MEMBER

[75] Inventors: Tom E. Marttila, Helsinki; Tuomo V. J. Kivistö, Kirkkonummi; Pentti V. Ahola, Kokkola, all of Finland

[73] Assignee: Outokumpu Oy, Helsinki, Finland

[21] Appl. No.: 369,055

[22] Filed: Jun. 20, 1989

[30] Foreign Application Priority Data

Jun. 22, 1988 [FI] Finland ..... 883012

[51] Int. Cl.[5] ..... B66C 13/08

[52] U.S. Cl. ..... 414/626; 204/225; 212/213

[58] Field of Search ..... 414/626, 560, 561; 294/907; 901/35; 212/213, 147; 204/225

[56] References Cited

U.S. PATENT DOCUMENTS

| | | | |
|---|---|---|---|
| 3,140,991 | 7/1964 | Gardiner | 204/225 X |
| 3,288,309 | 11/1966 | Fleisch | 212/128 |
| 3,722,709 | 3/1973 | Buschmann | 414/626 |
| 3,805,978 | 4/1974 | Hahne | 414/626 X |
| 3,888,362 | 6/1975 | Fletcher et al. | 414/626 X |
| 4,260,187 | 4/1981 | Bejczy | 294/907 X |
| 4,286,722 | 9/1981 | Tax et al. | 414/626 X |
| 4,382,848 | 5/1983 | Kosonen | 204/225 X |
| 4,496,063 | 1/1985 | Ishii et al. | 414/626 X |
| 4,622,300 | 5/1987 | McCallum et al. | 414/626 X |
| 4,883,576 | 11/1989 | Gemma | 204/225 X |
| 4,894,129 | 1/1990 | Leiponen et al. | 204/225 X |

FOREIGN PATENT DOCUMENTS

| | | | |
|---|---|---|---|
| 3410910 | 10/1985 | Fed. Rep. of Germany . | |
| 3508195 | 9/1986 | Fed. Rep. of Germany . | |
| 1041284 | 9/1983 | U.S.S.R. | 414/626 |
| 1207777 | 1/1986 | U.S.S.R. | 414/626 |

*Primary Examiner*—David A. Bucci
*Attorney, Agent, or Firm*—Brooks Haidt Haffner & Delahunty

[57] ABSTRACT

The invention relates to an automatic charging member for positioning of heavy loads, particularly sheet-like objects as anodes and cathodes into electrolysis tanks. According to the invention, between the loading member (1) and the gripping device (8) there is attached a control frame (3) so that on the ground of the information received from the position detectors (9) the positioning of the gripping device (8) is carried out by moving the control frame (3).

3 Claims, 1 Drawing Sheet

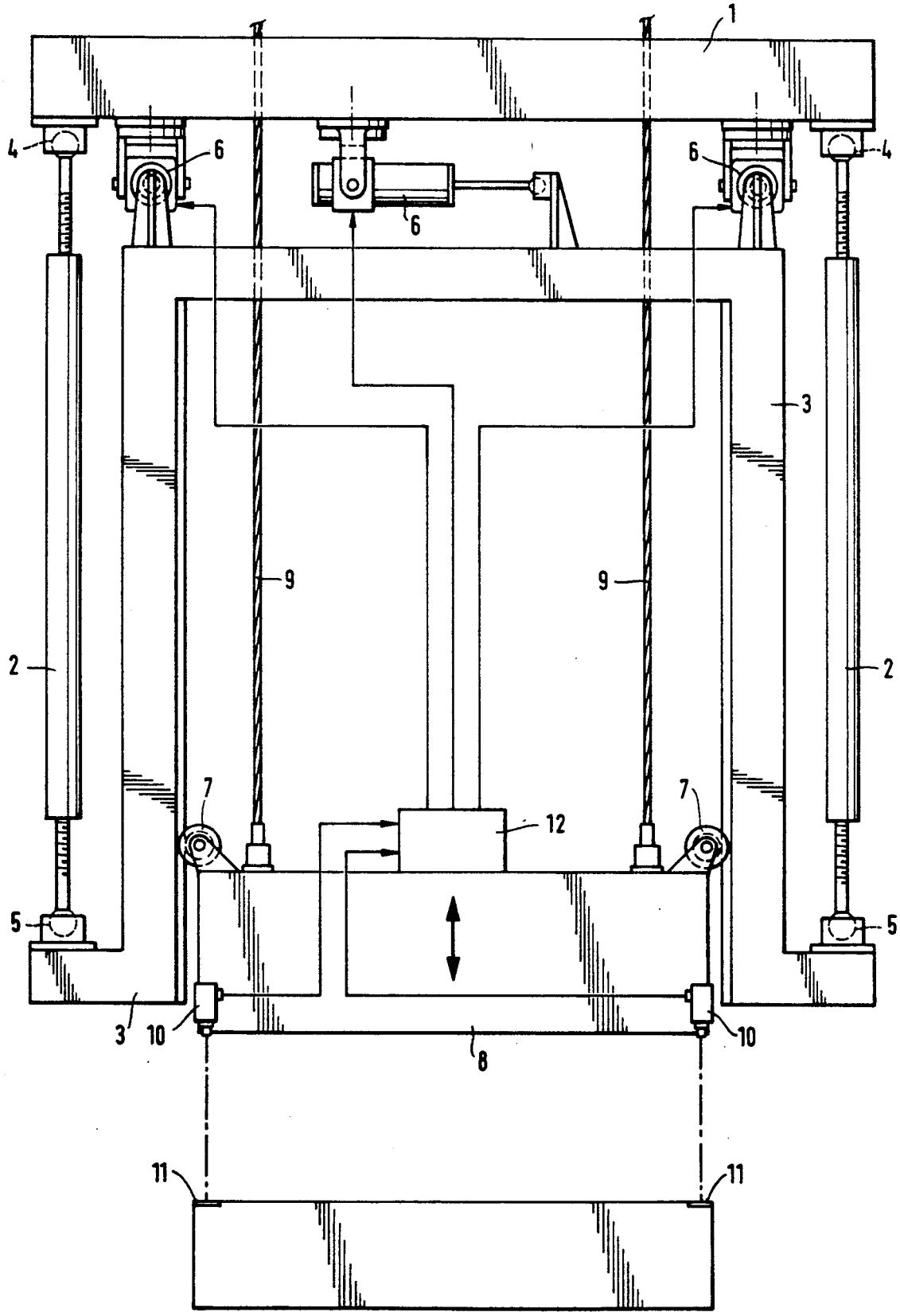
1
4
6
6
6
4
3
9
9
2
2
7
7
12
5
5
3
10
10
8
11
11

AUTOMATIC CHARGING MEMBER

BACKGROUND OF THE INVENTION

1. Field of the Invention

The invention relates to an automatic charging member which is attached to a loading member used in transfer tasks of heavy loads and which charging member performs the precise positioning of a load after the placing of the loading member. The invention particularly relates to an automatic positioning of sheet-like objects as anodes and cathodes in an electrolysis plant into electrolysis tanks.

2. Description of the Prior Art

Nowadays in many places, for example in electrolysis plants, the positioning of a load is performed in the following way: A crane operator positions the crane first in a way determined by a visual test, then more precisely by means of hand signs of persons below. The final precise positioning of the load is by the persons below pushing and pulling transfer the load hanging freely in wire ropes of the crane or the loading member during lowering downwards. The drawbacks of this method are slowness, bad preciseness, heavy and dangerous physical work and the great need for employees.

There is known from the DE patent application publication 3508195 an equipment where in the position target there are attached mechanical dowel pins which perform the precise positioning when the gripping device is lowered. These dowel pins are expensive, need a lot of space and they do not allow within reasonable external dimensions a great fault in the position of the loading member. In the equipment in accordance with the DE patent application publication 3508195 the motion of the precise positioning is achieved on sliding or rolling surfaces which also support the load and the gripping device. Using sliding and rolling surfaces it is impossible with reasonable external dimensions to achieve large trajectories, and furthermore those supporting the load are an object of acute strain requiring a rough dimensioning and maintenance, which makes them expensive. Because of the construction for the hoist of the loading member there is a considerably greater total load than the pure load and the gripping device.

In the apparatus of U.S. Pat. No. 4,894,129 into the loading member there is attached a solid connector along which a separate frame supported by the hoist is moving. Into this frame the gripping device is suspended by means of turnbuckles and the gripping device is transferred in relation with the frame in order to achieve a precise positioning. The separate frame cause for the hoist an extra weight. The turnbuckles participate in the supporting of the load and the gripping device, and they have to be essentially stronger. Because of their position the turnbuckles are short, and when shortening the turnbuckles there are getting worse the height changes and the inclinations which are caused by the position motions in connection with the suspension of the turnbuckles. In the apparatus of U.S. Pat. No. 4,894,129 these height changes and inclinations are directly objected to the gripping device and the load, and so the position passes remain essentially shorter and there is needed for the loading member an essentially better position preciseness.

The object of the present invention is to eliminate some of the drawbacks of the prior art and to achieve an improved and a more secure loading member suitable for transfer tasks of heavy loads, in which as a load of the hoist of the loading member there is only the load and the gripping device. The essential features of the invention are enlisted in the appended claims.

SUMMARY OF THE INVENTION

In the charging member according to the invention the gripping device is attached into the hoist of the loading member. Thus between the load and the hoist there is no motion member in lateral direction as a sliding or a rolling surface. So as a load of the hoist of the loading member there are only the load and the gripping device.

According to the invention in the derrick car or respectively of the loading member wherein also the hoist is usually situated, there is suspended a control frame by means of at least four suspension members. The suspension members are supporting only the weight of the control frame. The suspension members are advantageously essentially long, and therefore the motion for the positioning of the control frame can be large without that the plane-likeness and the perpendicular alignment of the control frame being essentially changed. Because there are at least four suspension members, the construction is stiff even within loadings in lateral dimensions which are caused for example when accelerating or braking the loading member. In the ends of the suspension members there is an articulated attachment so that it is possible for the control frame to move essentially freely around its mean position. Further, between the control frame and the loading member there are installed actuators by which the control frame is moved in relation to the loading member.

Between the gripping device and the control frame in the apparatus according to the invention there are control members which allow for the gripping device a free up and down motion, but bind it in lateral directions with the control frame. So the gripping device is moving in lateral directions with the control frame and it can be transferred and turned by transmission of the control frame using the actuators for moving of the control frame. The control between the gripping device and the control frame is advantageously such that it allows the changes in the angles therebetween. Then the inclinations of the control frame caused by the suspension members in the combined transferring and turning motions are not transmissioned to the gripping device and to the load. The position of the gripping device can also be adjusted, if needed, for example changing the mutual length of the lifting members. So, there can for example be eliminated the influence of the loading member and of the deflections in its rails as well as of other breakdown factors to the position of the gripping device.

According to the invention the gripping device is positioned in the target essentially automatically. In the gripping device there are attached advantageously two position detectors which include a matrix or video camera and a light source. If the turning motion of the gripping device connected to the control frame is not needed, there can be used only one camera. Because the position detectors are attached in the gripping device, neither the margins of the gripping device and of the control frame nor the margins of the control means therebetween have any essential influence on the position preciseness achieved.

In the position target of the charging member according to the invention there are position signs which amount is respective to the amount of the position detectors. The position signs are in shape regular figures, as circles, ovals and/or round or oval rings. The position signs are made advantageously of a material, as of a reflection film used in traffic signs, which reflects the light back to its source direction essentially better than other materials in the nearest surroundings. When the light source of the position detector is lightening a position sign, there is reflected from the sign light with a great intensity to the detector and the detector can advantageously be dimmed so that it is not seeing in its image field other things. In the image of the position detector there is so a bright sign with a dark background, and the image will be treated with a computer or with a special electronics in order to determine the position of the position sign. The image treatment of the detector is performed so that the margin line of the position sign is identified advantageously at least in 20 spots and the information from the identification is treated statistically with a computer when a considerable part of the surface and the margin of the sign may be destroyed or be covered with dirt without causing failure in the position measurement it is caused. The statistics of the image treatment also brings that advantage that the shape of the sign can be identified in which case the bright areas having other shapes in the image of the detector do not cause fault. The measurement of the position is advantageously so quick that on the ground of the information from the measurement of the position there can be automatic control of the actuators of the control frame so that the gripping device is kept in a sufficient preciseness above the target during the lifting and the lowering of the load.

The properties of the charging member according to the invention are an automatic operation, a great preciseness and velocity and particularly the unnecessity of the mechanical direction constructions and the advantageously large position trajectories. When in the using target, as in electrolysis plants, there are hundreds of position targets and when the targets are still placed essentially close to each other, the mechanical direction constructions in the target place become expensive and for them there is not often any space. The charging member according to the invention is suitable because of the lengths of its trajectories to an automatic and precisely positioned loading member as well as to a manual and unprecisely positioned loading member. The position preciseness required from the loading member is in its size class between ±150-±200 mm which is an essentially easier demand than in other known constructions which usually need from the loading member a better than ±50 mm preciseness in the position.

BRIEF DESCRIPTION OF THE DRAWINGS

In the following the invention is explained in more details with reference to the appended drawing which FIGURE is a schematical side-view illustration of a preferred embodiment of the invention.

DETAILED DESCRIPTION OF THE INVENTION

According to the figure a control frame 3 is attached with turnbuckles 2 to a loading member 1 of a crane. The turnbuckles 2 are so shaped that in the both ends of the turnbuckles there are ball articulates 4,5, which guarantee for the control frame 3 an essentially free motion with regard to its mean position Between the loading member 1 and the control frame 3 there are attached actuators 6 by means of which actuators the control frame 3 can be moved, if needed, with regard to the loading member 1. Further, to the control frame 3 there is attached a gripping device 8 so that the gripping device 8 is freely moved up and down by means of lifting wire ropes 9, but the motion of the gripping device 8 in lateral direction is prevented by means of the elements 7.

To the gripping device 8 there are attached the position cameras 10 by means of which observations from position signs 11 are stored into the memory of a computer 12. The computer 12 analyses observations received and on the ground of the analysis it automatically controls the actuators 6 which move the control frame, so that the load in the gripping device 8 can be precisely positioned in its using target.

We claim:

1. Automatic charging member for the positioning of heavy loads, particularly of sheet-like objects as anodes and cathodes into electrolysis tanks, which charging member has a loading member and a gripping device for gripping the load and position detectors for positioning the gripping device relative to the load, wherein between the loading member and the gripping device there is attached a control frame movable with respect to the loading member so that on the basis of information received form said position detectors positioning of the gripping device is carried out by moving the control frame and wherein the control frame and the gripping device are supported on the loading member by separate suspension members.

2. The charging member of claim 1 wherein the position detectors are attached to the gripping device.

3. The charging member of claim 1 or 2, wherein a computer connected to the position detectors is connected with actuators of the control frame for positioning of the gripping device.

* * * * *

UNITED STATES PATENT AND TRADEMARK OFFICE

CERTIFICATE OF CORRECTION

PATENT NO. : 5,151,006

DATED : September 29, 1992

INVENTOR(S) : Tom E. Marttila et al

It is certified that error appears in the above-identified patent and that said Letters Patent is hereby corrected as shown below:

Column 3, line 26:

"position measurement it is caused. The" should read:

--position measurement. The--.

Signed and Sealed this

Fifth Day of October, 1993

Bruce Lehman

*Attest:*

BRUCE LEHMAN

*Attesting Officer*

*Commissioner of Patents and Trademarks*